US006583538B1

(12) United States Patent
Adolf et al.

(10) Patent No.: US 6,583,538 B1
(45) Date of Patent: Jun. 24, 2003

(54) SPARK PLUG

(75) Inventors: Manfred Adolf, Schwaikheim (DE); Werner Niessner, Steinheim (DE)

(73) Assignee: Beru AG, Ludwigsburg (DE)

( * ) Notice: Subject to any disclaimer, the term of this patent is extended or adjusted under 35 U.S.C. 154(b) by 205 days.

(21) Appl. No.: 09/690,887

(22) Filed: Oct. 18, 2000

(30) Foreign Application Priority Data

Oct. 21, 1999 (DE) ..... 199 50 922

(51) Int. Cl.[7] ..... H01T 13/20; H01T 13/22; F02P 1/00

(52) U.S. Cl. ..... 313/141; 313/118; 313/145; 313/143; 123/169 R; 123/169 EL; 123/169 CL

(58) Field of Search ..... 313/141–146, 313/140, 118; 123/169 R, 169 CL, 169 EL, 169 E, 169 P

(56) References Cited

U.S. PATENT DOCUMENTS

| | | | | | |
|---|---|---|---|---|---|
| 1,192,602 | A | * | 7/1916 | Bond | 174/152 S |
| 1,216,139 | A | * | 2/1917 | Kopf | 174/152 S |
| 1,323,932 | A | * | 12/1919 | Trautman | 313/143 |
| 1,332,904 | A | * | 3/1920 | Kulick | 313/137 |
| 1,350,319 | A | * | 8/1920 | Longworth | 313/138 |
| 3,883,762 | A | * | 5/1975 | Harris et al. | 313/130 |
| 5,569,971 | A | * | 10/1996 | Clifford et al. | 313/136 |
| 5,877,584 | A | * | 3/1999 | Kato et al. | 313/141 |

FOREIGN PATENT DOCUMENTS

| | | | |
|---|---|---|---|
| FR | 572 446 | 6/1924 | |
| GB | 113 774 | 3/1918 | |
| JP | 04-249877 | 9/1992 | H01T/13/14 |

OTHER PUBLICATIONS

Examiner: E. Bijn, European Search Report, Date of Search: Jan. 17, 2001, pp.: 3, Place of Search: Den Haag.

* cited by examiner

*Primary Examiner*—Michael H. Day
*Assistant Examiner*—Anthony Perry
(74) *Attorney, Agent, or Firm*—Nixon Peabody LLP; David S. Safran

(57) ABSTRACT

Spark plug with an electrically insulating ceramic insulator (1), a metallic spark plug body (2), a ground electrode (3) and a middle electrode (4) which is located centrally in a hole (5) of the ceramic insulator (1), around the ignition-side end area on the periphery of the middle electrode (4) a peripheral tip (10) being formed which encompasses the middle electrode (4) in an annular manner.

9 Claims, 2 Drawing Sheets

SPARK PLUG

BACKGROUND OF THE INVENTION

1. Field of the Invention

This invention relates to a spark plug with an electrically insulating ceramic insulator.

2. Description of the Related Art

In these conventional popular spark plugs with a spark gap in air malfunctions often occur due to fouling; they include restart and cold starting problems which due to low shunt resistance of the insulator base which is caused by electrically conductive combustion residues (carbon) lead to malfunction of the spark plug.

SUMMARY OF THE INVENTION

Therefore, the object of the invention is to make available a spark plug with cold starting properties which have been greatly improved, in which the aforementioned problems are greatly reduced.

The object in accordance with the invention is achieved by providing a spark plug with an electrically insulating ceramic insulator, a metallic spark plug body, a ground electrode and a middle electrode centrally located in a hole of the ceramic insulator, whereby a peripheral tip is formed around the ignition-side end area on the periphery of the middle electrode, the peripheral tip encompassing the middle electrode in an annular manner.

BRIEF DESCRIPTION OF THE DRAWINGS

The invention is detailed using the attached FIGS. 1 and 2.

DETAILED DESCRIPTION OF THE INVENTION

Figure 1:
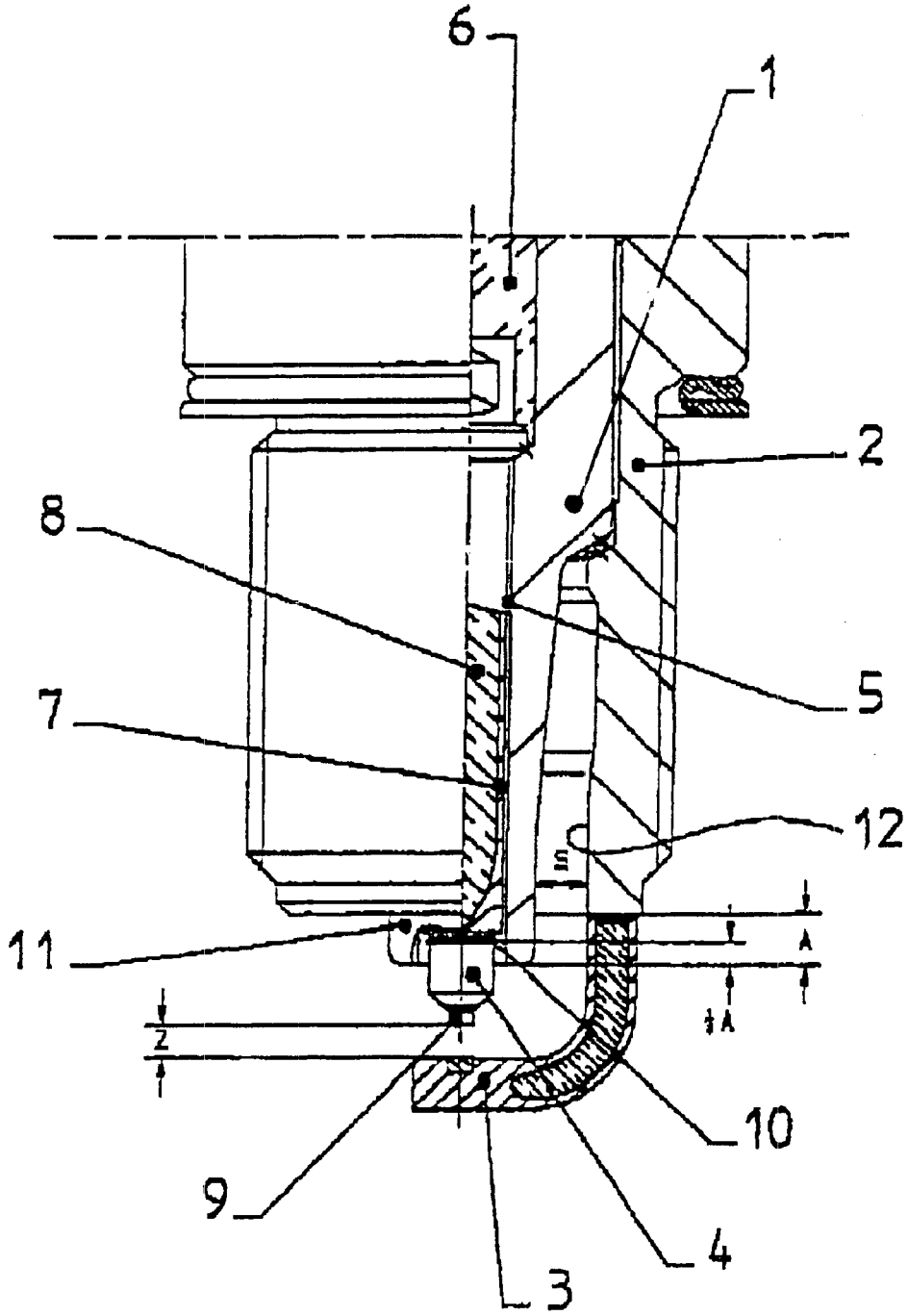
FIG. 1 shows a schematic of a first embodiment of a spark plug in accordance with the invention in partial lengthwise section.

The embodiment of the spark plug in accordance with the invention as shown in FIG. 1 has an electrically insulating ceramic insulator 1, a metallic spark plug body 2, a ground electrode 3 and a middle electrode 4 which is located centrally in a hole 5 of the ceramic insulator 1. Here, the middle electrode 4 is fixed with an electrically conductive sealing mass 6, preferably glass melted in the insulator hole.

In the preferred case of this embodiment the middle electrode 4 has a jacket of a nickel alloy 7 with a core 8 of a material with good heat conductivity, preferably copper.

The insulator base 11 which extends on the combustion space-side from the spark plug body 2 and projects on the combustion-space side from the spark plug body 2 by A surrounds the combustion space-side area of the middle electrode 4 which is tapered in this area relative to the middle electrode area which adjoins on the terminal side. In this tapered area of the middle electrode 4 and within the combustion space-side end area of the insulator hole 5 a tip 10 annularly runs around the middle electrode 4, the peripheral tip 10 is made burr-shaped in this case and has a pitch $\alpha$ of roughly 15 to roughly 90 degrees; it is molded on the jacket 7 of the middle electrode 4 or molded out of it.

While in this embodiment the combustion space-side area of the middle electrode 4 is tapered, one alternative consists in that this area is not tapered, but for this purpose the surrounding area of the insulator hole 5 has a greater diameter than the terminal-side hole area.

In this embodiment of the spark plug in accordance with the invention the middle electrode 4 is preferably provided with precious metal reinforcement 9; it has a diameter from roughly 0.5 mm to roughly 1.5 mm which corresponds essentially to the diameter of the middle electrode tip and preferably consists of a platinum alloy or an iridium alloy.

It is likewise provided that the gap S between the insulator base 11 and the hole diameter of the breathing space 12 of the spark plug body 2 has a width which is at least 1.5 times the ignition gap Z between the ground electrode 3 and the middle electrode 4.

Figure 2:
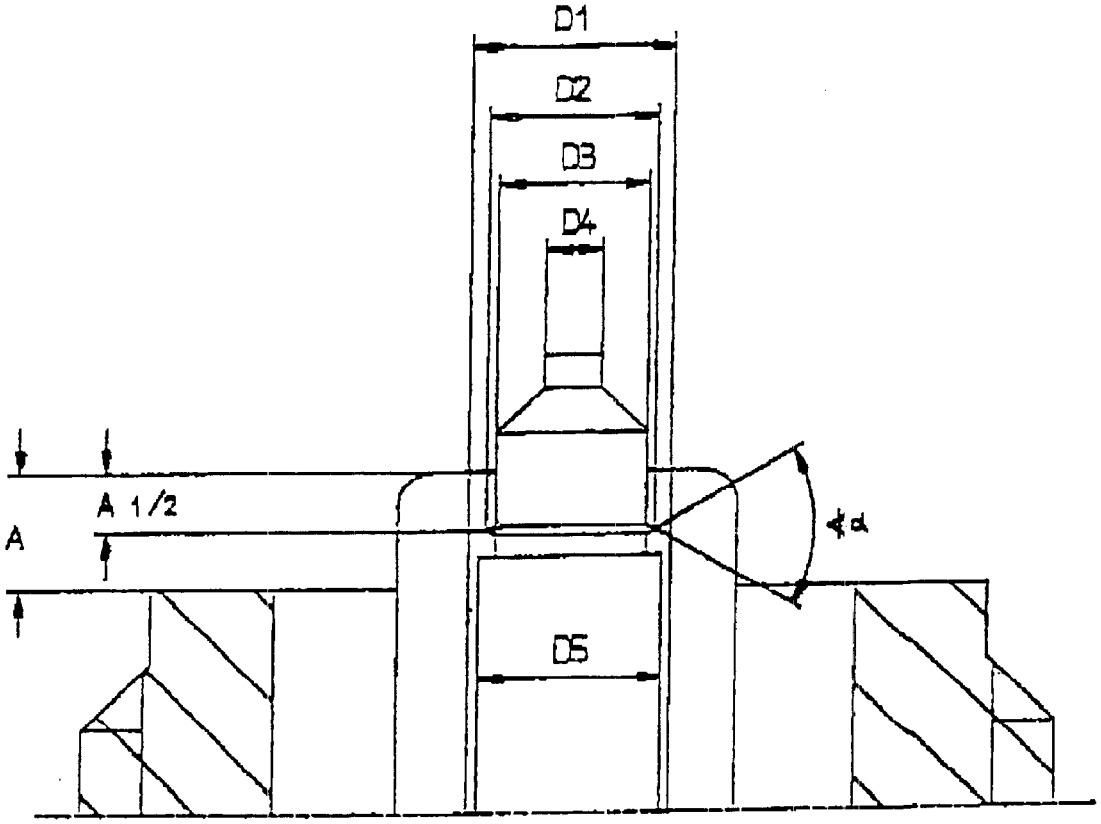
FIG. 2 shows a partial cross-section through the combustion space-side area of the insulator base of the spark plug version as shown in FIG. 1.

As shown in FIG. 2 the peripheral tip 10 is located roughly in the middle within the hole 5 on the tapered, combustion space-side area of the middle electrode 4; in this figure D1 labels the diameter of the insulator hole 5, D2 labels the diameter of the peripheral tip 10 including the inside middle electrode area, D3 the diameter of the tapered combustion space-side hole of the middle electrode 4, D4 the diameter of the frontmost tip of the middle electrode 4 and the precious metal reinforcement, and D5 labels the diameter of the middle electrode in the terminal-side area. There the following should preferably apply:

$$D2=D1-(0.3 \text{ to } 1.0) \text{ mm};$$

$$D3=D1-(0.5 \text{ to } 1.5) \text{ mm};$$

and $$D5=D1-(0.05 \text{ to } 0.1) \text{ mm}.$$

In accordance with the invention, the middle electrode 4 is geometrically formed and placed in a defined manner in the insulator hole 5 such that on the spark plug in extreme cold starting operation or in engine operation with an oxygen/fuel ratio $\lambda<1.0$ no shunt resistance forms on the insulating section of the insulator base between the middle electrode 4 and the spark plug body 2, which is <100 MOhm.

The geometrical formation of the middle electrode 4 in accordance with the invention with the sharp tip 10 which runs around the periphery of the jacket 7 of the middle electrode causes a local field peak increase, in conjunction with the fouled insulator tip a strong non-homogeneous field being formed which in turn is the prerequisite for formation of partial discharges, so-called corona discharges. During engine operation, before electrical breakdown on the spark gap between the middle electrode 4 and the ground electrode 3, targeted pre-discharges are formed between the sharp tip 10 on the middle electrode and the insulator hole 5.

For safe formation of a corona discharge there is a gap between the sharp tip 10 of the middle electrode 4 and the insulator hole 5 of at least roughly 0.15 mm. The structurally initiated pre-discharge causes a stable partial discharge. The discharge channels which grow from the partial discharge with a brush-shaped bluish discharge picture clean the insulator hole 5 and interrupt the electrical conductor strip of the insulator base 11 which is coated with soot particles to the ground potential of the spark plug body 2.

Fouling tests were run with the spark plugs in accordance with the invention; here the required cycle number of at least 25 was reached and thus the requirements for reliable engine starting, reliably acceleration of the engine upon accepting a load and good gas acceptance were met. Spark plugs with production middle electrodes and conventional geometrical installation dimensions failed after 5 to 8 cycles in this test, with the consequence that reliable starting of the engine, reliable acceleration of the engine and sufficient load acceptance could not be achieved.

Accordingly the spark plugs in accordance with the invention have outstanding cold starting properties and high resistance to fouling with the resulting malfunctions. The high shunt resistance of the combustion space-side current conduction path prevents parasitic discharge over the insulator base and leads to the best possible ignition of the fuel/air mixture.

What is claimed is:

1. A spark plug with an electrically insulating ceramic insulator (1), a metallic spark plug body (2), a ground electrode (3) and a middle electrode (4) which is located centrally in a hole (5) of the ceramic insulator (1), wherein around an ignition-side end area and within the ignition-side end area of the insulator hole (5) on the periphery of the middle electrode (4), a peripheral burr-shaped tip (10) is formed from the material from the middle electrode (4) and which encompasses the middle electrode (4) in an annular manner.

2. Spark plug as claimed in claim 1, wherein the peripheral tip (10) has a pitch $\alpha$ from 15 to 90°.

3. The spark plug as claimed in claim 1 or 2, wherein the middle electrode (4) comprises a jacket (7) and the tip (10) is formed from the material of the jacket (7).

4. The spark plug as claimed in claim 1 or 2, wherein the ignition-side area of the middle electrode (4) around which the tip (10) is located is reduced in diameter relative to the area of the middle electrode (4) which extends on the terminal side.

5. Spark plug as claimed in claim 4, wherein the relationship between the diameter D1 of the insulator hole (5), the diameter D2 of the reduced diameter portion of the middle electrode plus the peripheral tip (10), the diameter D3 of the reduced diameter portion of the middle electrode and the diameter D5 of the middle electrode portion that extends on the terminal side meets the following conditions:

$$D2=D1-(0.3 \text{ to } 1.0) \text{ mm};$$

$$D3=D1-(0.5 \text{ to } 1.5) \text{ mm};$$

$$D5=D1-(0.05 \text{ to } 0.1) \text{ mm}.$$

6. The spark plug as claimed in claim 1 or 2, wherein the tip (10) is located approximately in the middle of an amount A by which a base (11) of the insulator projects from the spark plug body (2).

7. Spark plug as claimed in claim 1 or 2, wherein the middle electrode (4) on the entire surface of an ignition tip is formed with a precious metal reinforcement (9) with a diameter from 0.5 mm to 1.5 mm.

8. The spark plug as claimed in claim 7, wherein the precious metal reinforcement (9) is formed from a platinum alloy or an iridium alloy.

9. The spark plug as claimed in claim 1 or 2, wherein a gap S is provided between the insulator base (11) and the diameter of a breathing space (12) of the spark plug body (2), the gap S having a width which corresponds to at least 1.5 times an ignition gap Z between the ground electrode (3) and the middle electrode (4).

* * * * *